United States Patent [19]

Abrams

[11] 4,180,297

[45] Dec. 25, 1979

[54] SEALING GROMMET IN A REFRIGERATOR CABINET

[75] Inventor: Donald W. Abrams, Atlanta, Ga.

[73] Assignee: General Electric Company, Louisville, Ky.

[21] Appl. No.: 835,946

[22] Filed: Sep. 22, 1977

[51] Int. Cl.[2] ..... F25D 23/08; H01B 17/58; H02G 3/22

[52] U.S. Cl. ..... 312/214; 16/2; 174/153 G; 277/178; 277/183; 312/236

[58] Field of Search ..... 174/65 G, 152 G, 153 G; 16/2; 248/27.1, 56; 277/178, 182, 183, 228; 312/214, 236; 339/94 A, 103 B; 62/81

[56] References Cited

U.S. PATENT DOCUMENTS

| | | | |
|---|---|---|---|
| 2,311,427 | 2/1943 | Winkelmeyer | 174/153 G X |
| 2,922,836 | 1/1960 | Brown | 174/153 G |
| 3,244,802 | 4/1966 | Sturtevant et al. | 174/153 G |
| 3,619,482 | 11/1971 | Boor | 174/152 G |
| 3,664,676 | 5/1972 | Petersen | 277/178 X |
| 4,097,096 | 6/1978 | Kochendorfer | 174/153 G X |

FOREIGN PATENT DOCUMENTS

| | | | |
|---|---|---|---|
| 1538622 | 7/1968 | France | 174/153 G |

*Primary Examiner*—Laramie E. Askin

*Attorney, Agent, or Firm*—Frederick P. Weidner; Radford M. Reams

[57] ABSTRACT

A sealing grommet is utilized to form a seal for articles such as electrical wires passing through the outer case of a refrigerator cabinet, the insulation, particularly foam insulation, between the outer case and the inner liner of the cabinet, and the inner liner. The grommet includes a substantially cylindrically shaped hollow body of a relatively rigid material disposed between the inner liner and the outer wall with a core of a relatively soft material supported by the inner surface of the body and secured thereto by glue, for example. Each of the body and the core is split longitudinally to receive the electrical wires with the core having a central longitudinal passage extending therethrough for an interference fit with the electrical wires. An integral mounting flange and a plurality of spaced locking lugs cooperate to mount the body on the inner liner. A separate grommet can be utilized at the outer case with the core having a sufficient length to extend into engagement with the adjacent surface of the separate grommet so that the core has a seal with the outer case through the separate grommet having a seal with the outer case. The body could have a mounting flange, similar to the mounting flange cooperating with the inner liner, for cooperation with the outer case rather than a separate grommet being employed.

8 Claims, 5 Drawing Figures

SEALING GROMMET IN A REFRIGERATOR CABINET

BACKGROUND OF THE INVENTION

In a side-by-side household refrigerator in which the freezer and fresh food compartments are closed by separate doors, air is circulated by a fan into each of the compartments and over an evaporator. The fan, various heaters, and various controls require electrical wires to be connected thereto. Thus, it is necessary for these electrical wires to pass through openings in the outer case of the cabinet, the insulation between the outer case and the inner liner of the cabinet, and the inner liner of the refrigerator cabinet.

This necessitates openings being cut in both the inner liner and the outer case of the cabinet. It is also necessary to cut a passage through the insulation between the openings in the inner liner and the outer case.

Accordingly, mechanical protection must be provided at each of the openings formed in the inner liner and the outer wall of the refrigerator cabinet to prevent damage to the electrical wires. It also is necessary to have an air seal at each of the openings to reduce migration of moisture into the insulation and to minimize air leakage into the refrigerator cabinet.

Additionally, when the insulation between the inner liner and the outer case of the refrigerator cabinet is foam insulation, it is necessary for the electrical wires to be isolated from the foam insulation adjacent the openings in each of the inner liner and outer case of the refrigerator cabinet. This is a requirement of the Underwriter's Laboratory.

One previous way of supporting the electrical wires has been to dispose an outer case grommet, which has the electrical wires molded thereto, in the opening in the outer case. Then, the electrical wires have been disposed through a slit in a foam seal of a flexible material into a longitudinal passage extending through the core. However, this seal must be flexible to fit within the passage cut within the insulation and still receive the electrical wires. Because the seal is flexible, it may be distorted during insertion through the passage cut in the insulation to leave gaps between the seal and the insulation whereby there can be excess heat leakage. When this occurs, sweat can form on the surface of the grommet, which is disposed in the outer case of the refrigerator cabinet.

To pass the electrical wires through the inner liner without damage thereto, a vinyl split grommet has previously been employed. Because of the electrical wires passing through the grommet, it has been difficult to properly seat the grommet in the outer case.

When the foam seal of the previously suggested arrangement becomes distorted, it does not have any seal with the grommet in the inner liner. Thus, this also causes further heat leakage problems.

SUMMARY OF THE INVENTION

An object of this invention is to provide an effective, one-piece sealing grommet for articles such as electrical wires passing through a refrigerator cabinet from the ambient into an insulated compartment.

Another object of this invention is to provide a grommet that complies with requirements of the Underwriter's Laboratory for electrical wiring when foam insulation is used between the inner wall and outer case of a refrigerator cabinet.

A further object of this invention is to provide the combination of a refrigerator cabinet and a sealing grommet with the sealing grommet being disposed within a passage in the foam insulation between the inner wall and the outer case of the refrigerator cabinet.

It is still another object of the invention to provide a sealing grommet which is sufficiently rigid to withstand the relatively high pressures associated with the foaming of foamed-in-place refrigerator insulation so that the grommet may be installed prior to the foaming operation, thereby obviating the need for cutting a passage through the insulation after it has rigidified.

Briefly stated, and in accordance with one aspect of the present invention, these and other objects are accomplished by the combination of a refrigerator cabinet and a grommet disposed in a passage in insulation between the inner and outer walls of the cabinet. The grommet includes a hollow body of relatively rigid material having a single longitudinal passage extending therethrough with a core of a relatively flexible material disposed within the longitudinal passage in the body for support by the body and in air sealing relation with the body. The core has a longitudinal passage extending therethrough, and each of the body and the core is slit longitudinally to enable the passage of the core to receive at least one article therein for passage therethrough. Mounting means is secured to one end of the body and attaches the body to one of the inner and outer walls of the refrigerator cabinet and in air sealing relation therewith to seal the opening in the inner wall. The core is in air sealing relation with the other of the inner and outer walls of the refrigerator cabinet to prevent any contact of the insulation with any article passing through the passage of the core.

The outer case grommet of the previously suggested arrangement may be employed with the sealing grommet of the present invention. By selecting the length of the flexible core so that it extends into engagement with the adjacent surface of the outer case grommet even if the distance between the inner case and the outer liner is a maximum, there is a seal therebetween even if the hollow support body, which has its length equal to the minimum distance between the inner liner and the outer case, terminates prior to the outer case grommet because the distance between the inner case and the outer liner is greater than the minimum.

Additionally, the sealing grommet of the present invention could have an outer case grommet integral therewith in the same manner as the mounting means for the inner liner. In such an arrangement, the sealing grommet of the present invention would require means for cooperation with the inner liner to accommodate the varying distances between the inner liner and the outer case of the refrigerator cabinet beyond the minimum distance therebetween and up to the maximum distance due to manufacturing tolerances.

BRIEF DESCRIPTION OF THE DRAWINGS

The attached drawing illustrates a preferred embodiment of the invention, in which.

DESCRIPTION OF THE PREFERRED EMBODIMENTS

Figure 1:
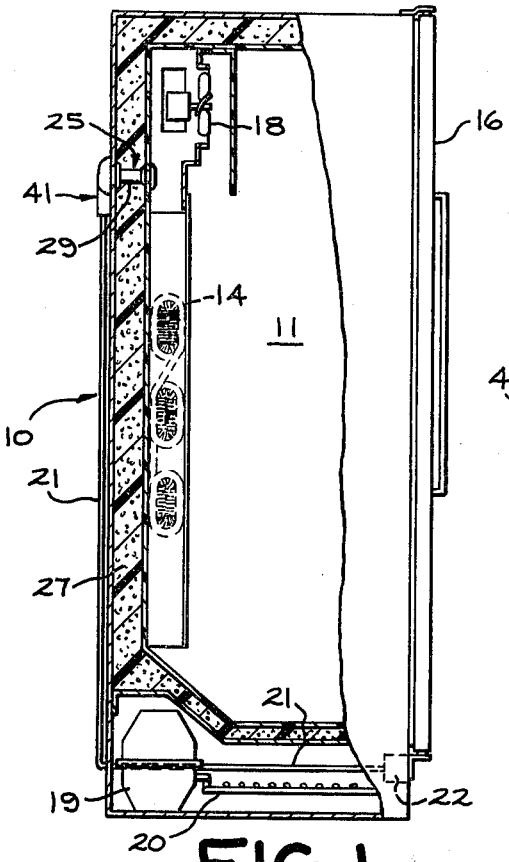
FIG. 1 is a schematic sectional view, partly in elevation, showing a refrigerator cabinet having the grommet of the present invention.

Referring to the drawing and particularly FIG. 1, there is shown a refrigerator cabinet 10 having a freezer compartment 11 and a fresh food compartment (not shown) formed therein. An evaporator 14 of a refrigerant system to cool both the freezer compartment 11 and the fresh food compartment is positioned in a manner similar to that shown and described in U.S. Pat. No. 3,678,698 to Gelbard et al, the disclosure of which is hereby incorporated by reference.

A door 16, which is hingedly mounted on the cabinet 10, closes the opening to the freezer compartment 11. Similarly, a door (not shown), which is hingedly mounted on the cabinet 10, closes the opening to the fresh food compartment.

As more particularly shown and described in the aforesaid Gelbard et al patent, a fan 18 circulates air to supply cool air to the freezer compartment 11 and the fresh food compartment. The air flows over the evaporator 14 in heat exchange relation therewith. The refrigerator cabinet 10 has a compressor 19 and a condenser 20 disposed exteriorly of the freezer compartment 11 and the fresh food compartment and forming part of the refrigerant system with the evaporator 14.

Figure 2:
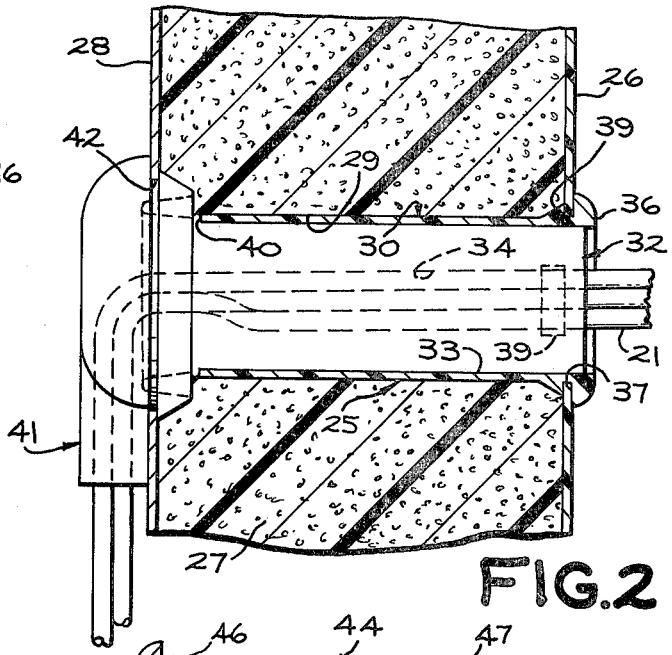
FIG. 2 is a fragmentary sectional view of a portion of the cabinet of FIG. 1 within which the grommet is disposed.

Electrical wires 21 extend from a control box 22, out through the rear wall of the cabinet 10, up the outside rear wall of the cabinet 10, and then pass into the interior of the freezer compartment 11 through a grommet 25 of the present invention. It will be appreciated that the electrical wires 21 are exemplary only and that wires from other locations or even refrigerant tubing may pass through the grommet 25, or through similar grommets appropriately located. As shown in FIG. 2, the refrigerator cabinet 10 has the grommet 25 supported at one end by inner liner 26 of the cabinet 10 and then extending through foamed-in-place insulation 27, which is between the inner liner 26 and an outer case 28 of the cabinet 10.

A longitudinal passage 29 through which the grommet 25 passes may be cut in the insulation 27 after the insulation 27 has been foamed in place and allowed to rigidify, as was done for prior art grommets. Alternatively, due to the enhanced rigidity of the present grommet 25, it may be positioned prior to the foaming operation. As is known in the art of refrigerator cabinets, relatively high pressures are produced during the foaming operation. However, grommets according to the present invention may be constructed to effectively resist this pressure, thereby eliminating the need for and attendant cost of cutting a passage in the insulation.

The grommet 25 includes a hollow body or shell 30 which is formed of a relatively rigid material such as a thermoplastic, for example. One suitable example of the thermoplastic material is ABS (acrylonitrile-butadiene-styrene).

Figure 4:
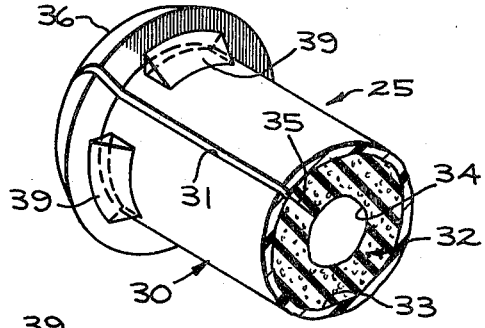
FIG. 4 is a rear perspective view, partly in section, of the grommet of the present invention.

The body 30 has a longitudinal slit 31 (see FIG. 4) extending for its length. The slit 31 enables the electrical wires 21 to be pushed into the interior of the body 30 during assembly.

The body 30 has a core 32 disposed therein and supported by inner surface 33 of the body 30. The core 32 must be formed of a material capable of forming a seal while still being flexible to accommodate the electrical wires 21 passing therethrough. One suitable example of the material of the core 32 is foam polyvinylchloride.

The core 32 has a centrally disposed longitudinal passage 34, which preferably has a circular cross section, extending therethrough. The diameter of the passage 34 is less than the overall configuration of the electrical wires 21 so that there is an interference fit between the electrical wires 21 and the core 32 to prevent any leakage therethrough.

The core 32 has a longitudinal slit 35 therein. The slit 35 is preferably formed without the removal of any of the material of the core 32. Thus, after the electrical wires 21 have been passed through the longitudinal slit 31 in the body 30 and the longitudinal slit 35 in the core 32, the slit 35 in the core 32 will again be closed to prevent any leakage of air therethrough.

The body 30 includes a mounting flange 36 at one end of the body 30 and of larger diameter than an opening 37 in the inner liner 26 with which the passage 29 in the insulation 27 communicates. The body 30 has a plurality of spaced locking tabs 39 around the circumference of the body 30 spaced from the mounting flange 36 to bear against the inner liner 26 of the refrigerator cabinet 10 on the opposite side to that against which the mounting flange 36 is engaging.

The length of the body 30 is such that its end 40 abuts an outer case grommet 41, which has the wires 21 molded thereto and is supported within an opening 42 in the outer case 28 communicating with the passage 29 in the insulation 27, when the distance between the inner liner 26 and the outer case 28 is the minimum. When manufacturing tolerances cause the distance between the inner liner 26 and the outer case 28 to exceed the minimum, the end 40 of the body 30 is spaced from the grommet 41 as shown in FIG. 2. However, the length of the core 32 is selected so that it extends beyond the end 40 of the body 30 and engages the grommet 41 even when the distance between the inner liner 26 and the outer case 28 of the refrigerator cabinet 10 is the maximum due to manufacturing tolerances. Thus, the core 32 always seals against the grommet 41. When the distance between the inner liner 26 and the outer case 28 is less than the maximum, there is a bulge of a portion of the core 32 between the end 40 of the body 30 and the grommet 41 as shown in FIG. 2.

The core 32 is retained within the body 30 through being secured to the inner surface of the body 30 by any suitable means. For example, the core 32 could be glued to the inner surface 33 of the body 30.

Figure 5:
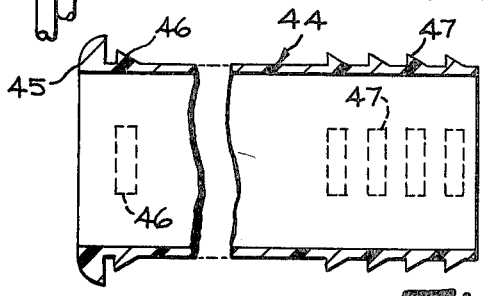
FIG. 5 is a fragmentary sectional view of a portion of another embodiment of the grommet of the present invention.
Figure 3:
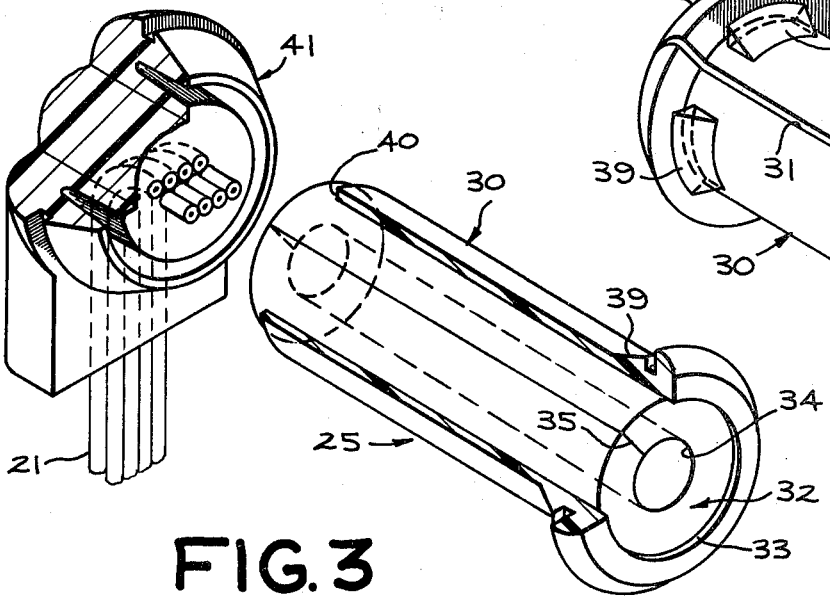
FIG. 3 is a perspective view, partly in section, of the grommet of the present invention and the outer case grommet with which it is used.

Referring now to FIG. 5, an alternative embodiment of the invention is shown. Here, a hollow body 44 has a mounting flange 45 integral therewith which generally replaces the outer case grommet 41 (FIGS. 2 and 3). The mounting flange 45 is similar to the previously described mounting flange 36, except that its position preferably is reversed. That is, it bears against the outer case 28 rather than the inner liner 26. A plurality of spaced locking tabs 46 is spaced from the mounting flange 45 to bear against the side of the outer case 28 on the opposite side to that against which the mounting flange 45 is engaging.

The other end of the body 44 is adapted to be inserted through the opening 37 (FIG. 2) in the inner liner 26. A plurality of sets of detents 47 is provided to engage the inner liner 26 to positively hold the body 44 in position. The provision of a plurality of sets of detents 47 spaced along the length of the body 44 permits a wide range of inner liner to outer case spacings to be accommodated. For smaller case spacings, a portion of the other end of the body 44 projects past the inner liner 26. In most cases, this excess will be within and be concealed by a control housing. In other cases where the excess may be visible, it can merely be cut off.

While the present invention has shown and described the core 32 being secured to the inner surface 33 of the body 30 by glue, for example, it should be understood that it is only necessary for the core 32 to be secured to the body 30 during assembly to prevent relative motion therebetween. Thus, any suitable means for preventing relative motion between the core 32 and the body 30 may be employed and is required only during assembly.

While the present invention has shown the longitudinal slit 35 in the core 32 and the longitudinal slit 31 in the body 30 being aligned, it should be understood that such is not a requisite. That is, the slit 35 could be rotated away from the slit 31 and the electrical wires 21 passed through the slit 31, then the core 32 being flexed sufficiently to enable the electrical wires 21 to enter the slit 35 and then pass into the longitudinal passage 34 in the core 32.

An advantage of this invention is that it prevents excessive heat leakage. Another advantage of this invention is that it reduces migration of moisture into the insulation. A further advantage of this invention is that it is not damaged by the relatively high pressures associated with producing foam insulation.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. In combination, a refrigerator cabinet having inner and outer walls, insulation between the inner and outer walls, an opening in each of the inner and outer walls, the insulation having a passage to provide communication between the openings in the inner and outer walls, a grommet disposed in the passage in the insulation, said grommet comprising:

a longitudinal, hollow body of a relatively rigid material having a single longitudinal passage extending therethrough;

a core of a relatively flexible material disposed within said longitudinal passage in said body for support by said body and in air sealing relation with said body, said core having a longitudinal passage extending therethrough;

each of said body and said core being slit longitudinally to enable said passage of said core to receive at least one article therein for passage therethrough;

mounting means secured to one end of said body and attaching said body to one of the inner and outer walls of the refrigerator cabinet in air sealing relation therewith;

and said core being in air sealing relation with the other of the inner and outer walls of the refrigerator cabinet to prevent any contact of the insultion with any article passing through said passage of said core.

2. The combination according to claim 1, wherein said mounting means is integral with said body.

3. The combination according to claim 1, wherein said body has its inner surface supporting said core and said core is secured to the inner surface of said body.

4. The combination according to claim 1, wherein said core seals against a portion of the other of the inner and outer walls of the refrigerator cabinet.

5. The combination according to claim 4, wherein:

said one of the inner and outer walls of the refrigerator cabinet is the inner wall of the refrigerator cabinet, and said other of the inner and outer walls of the refrigerator cabinet is the outer wall of the refrigerator cabinet; and said portion of the other of the inner and outer walls of the refrigerator cabinet is an outer case grommet.

6. The combination according to claim 5, wherein said core extends beyond the other end of said hollow body to always engage the outer case grommet irrespective of whether the other end of said hollow body engages the outer case grommet.

7. The combination according to claim 1, wherein said body has an outer surface of a substantially constant diameter, said body is of substantially cylindrical shape, the other end of said body is inserted through the opening in the other of theinner and outer walls of the refrigerator cabinet, and said outer surface of said body has a set of detents engaging the other of the inner and outer walls of the refrigerator cabinet to positively hold said body in position.

8. The combination according to claim 7, wherein a plurality of sets of detents is spaced along the length of said outer surfaces of said body to accommodate a range of spacings between the inner and outer walls of the refrigerator cabinet with only one of said set of detents engaging the other of the inner and outer walls of the refrigerator cabinet.

* * * * *